United States Patent [19]

Lunshof et al.

[11] 4,441,209

[45] Apr. 3, 1984

[54] PLASTIC BAG COMPRISING VENTING MEANS

[75] Inventors: Willem Lunshof, De Enschede; Leonardus H. M. Beukers, Hardenberg, both of Netherlands

[73] Assignee: Wavin B.V., Zwolle, Netherlands

[21] Appl. No.: 355,233

[22] Filed: Mar. 5, 1982

[30] Foreign Application Priority Data

Mar. 9, 1981 [NL] Netherlands ..... 8101126

[51] Int. Cl.[3] ..... B65D 30/24

[52] U.S. Cl. ..... 383/45; 383/56

[58] Field of Search ..... 229/62.5, DIG. 14; 150/9; 141/286, 68; 383/44, 45

[56] References Cited

U.S. PATENT DOCUMENTS

| | | | |
|---|---|---|---|
| 2,040,337 | 4/1935 | Rosmait | 229/62.5 |
| 2,904,241 | 9/1959 | Gorton et al. | 229/62.5 |
| 2,968,432 | 1/1961 | Craighead | 229/62.5 |
| 3,000,551 | 9/1961 | Atwood | 229/62.5 |

FOREIGN PATENT DOCUMENTS

| | | | |
|---|---|---|---|
| 1920097 | 12/1970 | Fed. Rep. of Germany . | |
| 1949086 | 4/1971 | Fed. Rep. of Germany . | |
| 622532 | 1/1963 | France . | |
| 7410169 | 2/1975 | Netherlands . | |
| 7811426 | 5/1980 | Netherlands . | |
| 332058 | 7/1930 | United Kingdom | 229/62.5 |

*Primary Examiner*—Steven M. Pollard
*Assistant Examiner*—David Voorhees
*Attorney, Agent, or Firm*—Wilkinson, Mawhinney & Theibault

[57] ABSTRACT

A plastic bag provided with a filling valve and a gas permeable dust filtering pocket opposite said valve, allowing gas to escape from the interior of the bag.

A disconnectable spot adhesive connection exists between a layer of said pocket and the adjacent bag wall parts opposite a corner flap. An additional adhesive or welding connection may be present near the free end of the pocket for connecting the layer with the bottom flaps.

9 Claims, 9 Drawing Figures

PLASTIC BAG COMPRISING VENTING MEANS

BACKGROUND OF THE INVENTION

1. Field of the Invention

The present invention relates to a plastic bag provided with a filling valve and a gas permeable dust filtering filtering layer situated at the same bag end as the filling valve and forming a gas permeable connection between the inner side of the bag and the outer side of the bag to permit gases to escape from the interior of the bag during and after the filling of the bag with filling material, said filtering layer being at least partially covered by at least one corner flap part of the bag and a bottom layer of said bag.

2. Description of the Prior Art

A plastic bag with a filling valve is known in the art. In said known plastic bag a pocket is situated opposite the filling valve, said pocket consisting of a non-woven of thermoplastic material, more particularly a non-woven of polyester fibers, polypropylene fibers or polyethylene fibers, the pocket being connected on the one hand to a bottom layer of the bag and on the other hand to a corner flap part situated opposite thereto. A pocket of this type is advantageous as it permits air used during the filling of such a plastic bag with finely powered filling material, to easily escape from the plastic bag both during and after said filling operation, the said pocket presenting the additional advantage that its presence enables to easily remove a smooth plastic bag from the filling nozzle of a filling machine.

In some cases said known plastic bag is inappropriate as during the filling of the bag with a finely powered material the filtering layer may entirely or partly loose its gas permeable dust filtering property, at which event there is even a danger of explosion of the plastic bag to be filled, because the air used for filling the bag is no longer able to escape.

Said drawback especially results from air flowing into the plastic bag simultaneously with filling material and exerting a pressure upon the corner flap part, so pressing said corner flap part in the direction of the opposite bottom layer of the bag, that the air has to escape substantially from the plastic bag in the direction of the filtering layer. The air permeability of the filtering layer in the direction of the filtering layer is, however, considerably less than perpendicular to the filtering layer.

Additionally, filling nozzles blowing air and powder into the bag toward the venting pocket, may cause said pocket to get turned over which will also decrease the venting capacity of said pocket.

SUMMARY OF THE INVENTION

It is a primary object of the present invention to provide a plastic bag of the abovedescribed type, which does not have these drawbacks and in which any danger of explosion of a bag during the filling operation is absolutely excluded, as air will at any time be able to escape from the plastic bag.

This object is attained according to the invention in that the bag is provided with means for maintaining the venting capacity of the filtering layer in order to maintain a gas permeable connection between the inner side of the bag and the outer side of the bag, at least during the filling of the bag.

The use of means for maintaining the venting capacity of the filtering layer ensures an appropriate connection between the inner side and the outer side of the bag, thus allowing air flowing into said bag, to easily escape through the gas permeable filtering layer.

Very advantageously the means for maintaining the venting capacity of the filtering layer consists of a disconnectable connection between a corner flap part of the bag which partially covers the filtering layer and an opposite portion of the wall of the bag.

Due to the use of a disconnectable connection of this type, constituted by means for maintaining the venting capacity of the filtering layer, it is attained that an extremely appropriate gas permeable connection is maintained between the inner side of the bag and the outer side of the bag during the filling operation, which connection may be easily disconnected after having filled the bag, so that said filled bag may obtain a block shape in case that the bag is provided with a so-called block-bottom, causing the filled bag to obtain a rectangular shape when being put down.

In a particularly advantageous embodiment the disconnectable connection consists of a plastic glue material, said plastic glue material on the one hand consisting of material remaining after the solvent has evaporated from a plastic glue and on the other hand, from an adhering means, providing a connection by heating the adhering means, to wit so-called hot-melt adhering means.

The disconnectable connection advantageously consists of a continuous layer of material used for forming a glue connection, which layer extends continuously through at least one opening in the corner flap between the filtering layer and a wall portion of the bag situated opposite said corner flap.

The features of the present invention which are believed to be novel are set forth with particularity in the appended claims.

Other claims and many of the attendant advantages will be more readily appreciated as the same become better understood by reference to the following detailed description and considered in connection with the accompanying drawings in which like reference symbols designate like parts throughout the figures.

DESCRIPTION OF THE PREFERRED EMBODIMENTS

Figure 1:
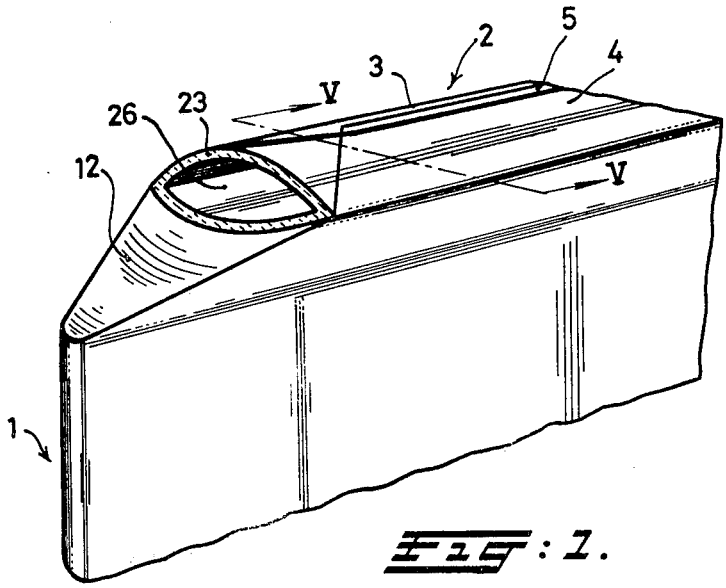
FIG. 1 is a perspective view of a plastic bag according to the present invention.

Referring now to FIG. 1 a plastic bag comprises a front bag foil layer and a rear bag foil layer, which layers form together an integral tubular foil.

The bag comprises a bottom 2 formed from a first bottom flap 3 and a second bottom flap 4 interconnected with each other by a glue or welding connection 5.

Figure 2:
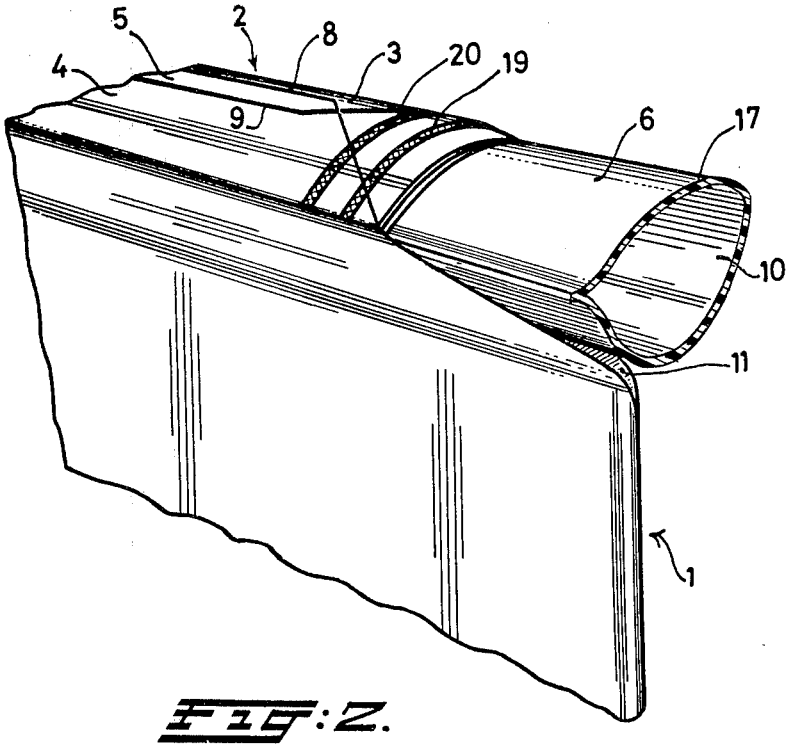
FIG. 2 is another view of the plastic bag comprising a filling valve of FIG. 1.

Referring now to FIG. 2 the first bottom flap 3 and the second bottom flap 4 comprise a bottom flap end edge 8 and 9, respectively.

Figure 3:
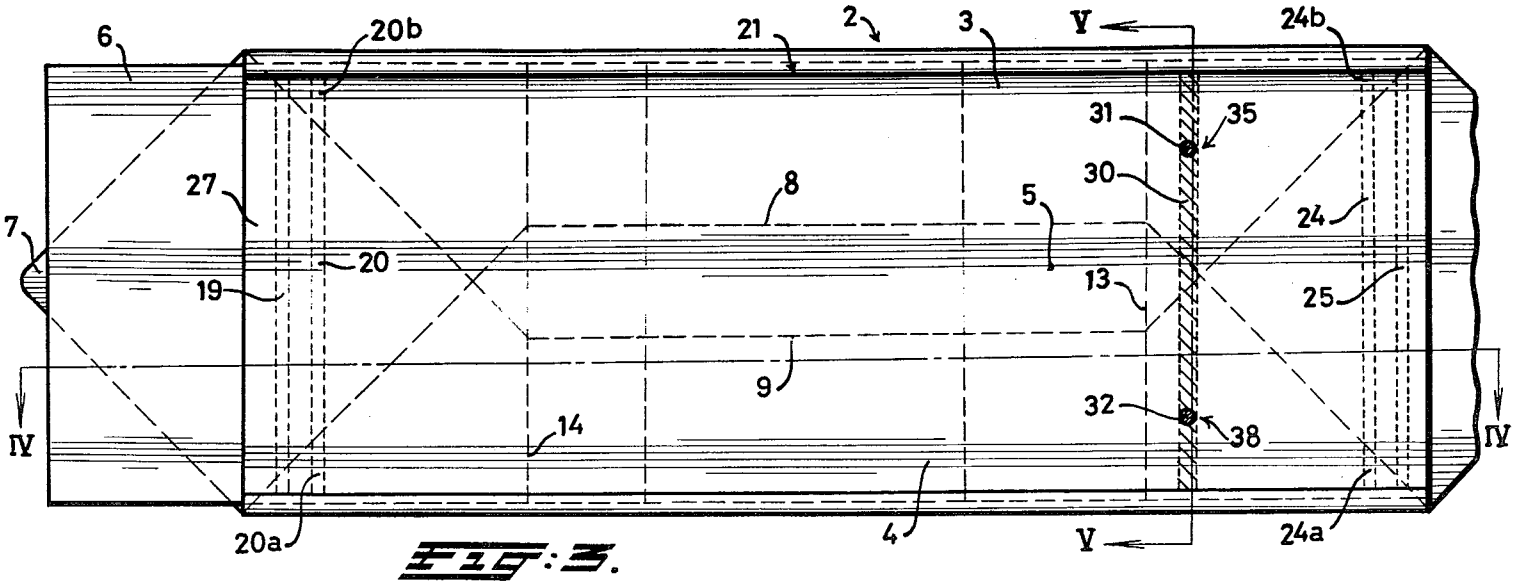
FIG. 3 is a plan view of a plastic bag according to the invention, having a flat bottom.

The first and second corner flap 11 and 12 have been formed simultaneously with the bottom, the first corner flap 11 being provided with a first corner flap edge 14 situated within the bag (see FIGS. 1, 2 and 3).

The second corner flap 12 is provided with an end edge 13 (FIG. 3).

After having folded the corner flap parts 11 and 12 a valve tube 6 is provided at the location of corner flap 11 and an end portion 16 of the latter is folded toward the projecting end of the said valve tube.

The valve tube 6 forms a filling valve edge 18 situated within the bag and extending further into the bag than the end edge 14 of the first corner flap edge 11.

On the other hand, the free end edge 17 of the filling valve tube 6 projects outside the bag. By means of one or more glue connections 19 and 20 the tubular foil is fixed to the corner flap 11 and a bottom covering foil layer 21, being adhered or welded along the folded over bottom flap parts 3 and 4.

Additionally a pocket 22 is disposed upon the second corner flap 12, said pocket having a length such that the same extends within the plastic bag to beyond the end edge 13 of the second corner flap 12 situated at the inner side of the bag. Near the free edge 23 of the pocket 22 of polyester non-woven material, polypropylene non-woven material, or polyethylene non-woven material, generally a thermoplastic non-woven material, a connection by means of at least one glue or welding connection 24 and 25 is accomplished with a bottom covering layer 21, covering the bottom flaps 3 and 4 folded toward each other and on the other hand with the portion of the second corner flap 12 situated directly subjacent said corner flaps. Obviously, pocket 22 may also be connected to the bottom flaps 3 and 4 slung over each other.

From the foregoing it follows that the inner side of pocket 22 is connected to the outer side in order to permit air enclosed in the bag, to escape by means of the dust filtering air permeable pocket 22. Said air permeable pocket 22 comprises layers **22*a* and 22*b*, the edges of said layers being interconnected while forming the pocket 22**.

After having filled the plastic bag by means of a filling machine, during which operation the bag suspends from said filling machine through the filling valve 6, said bag can be easily removed from the filling machine, as putting one's hand into pocket 22 considerably facilitates the removal of a smooth plastic bag, from the filling machine.

For the latter purpose the mouth 26 of pocket 22 of fibrous material is opened whereupon a hand can be put into pocket 22 until the bottom 15 of said pocket is contacted. As can be seen said bottom 15 extends into the bag to beyond the edge 13 of the second corner flap 12. As can be seen, the second corner flap 12 and the bottom covering foil 21 are unable to contact each other so that a good venting is ensured. As illustrated, the glue strip portions **24*a* and 24*b* connect layer 22*a* of the pocket with the slung over bottom flaps 3 and 4**.

In order to fill the bag, the mouth 10 of the filling valve foil 6 is opened.

Reverting now to FIG. 3 the glue strip portions **20*a* and 20*b* are provided between the tubular foil 2 and the inner side of the slung over bottom flaps 3 and 4. In order to prevent loose covering-layer portions, region 27 of the slung back portion of the tubular foil, is advantageously glued to the covering layer 21**.

Figure 4:
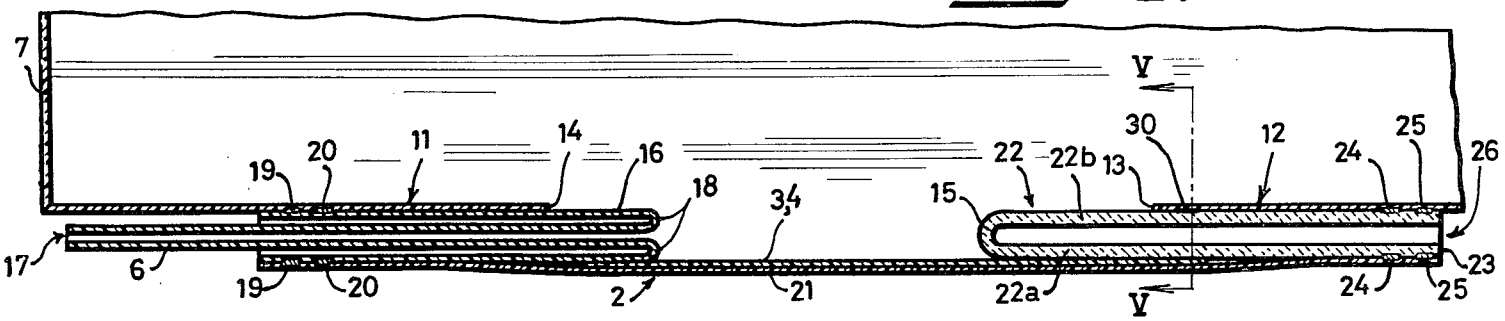
FIG. 4 is a section according to line IV—IV in FIG. 3.

So as to ensure a good venting, during the filling of the bag, corner flap 12 is provided with apertures 35 and 38 at the location of a glue connection 30 subsequently to be applied and extending between the outer side of layer **22*b* of the non-woven pocket 22 and the corner flap 12 (see also FIG. 4**).

Figure 5:
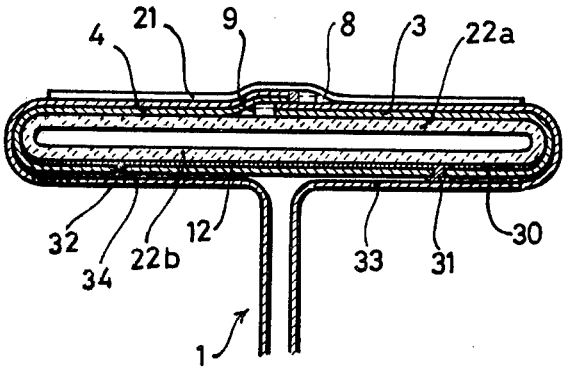
FIG. 5 is a section according to line V—V in FIG. 4.
Figure 5A:
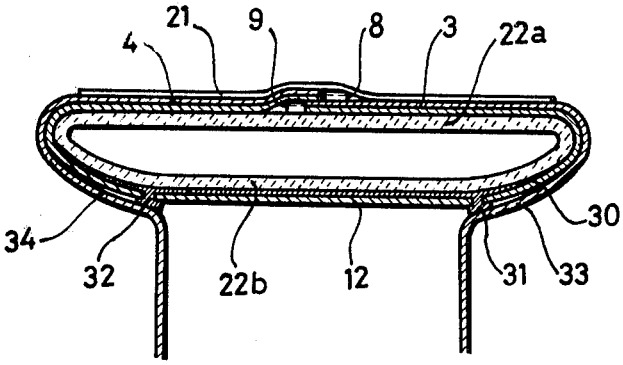
FIG. 5*a* is a section similar to that of FIG. 5 during the filling of the bag.

The glue of glue connection 30 penetrates into these apertures 35, 38, thus providing a glue connection 31, 32 between the corner flap 12 and the bag wall parts 33 and 34 situated opposite said corner flap 12 (FIG. 5). Applying a glue binding or connection of this type by means of a hot-melting plastic results in an extremely good connection which ensures a constant venting capacity of the non-woven pocket 22 during the filling of the bag. Thus a good gas permeable connection beween the inner side of the bag and the outer side of the bag is maintained. Such means for maintaining the venting capacity of the filtering layer in the form of a disconnectable connection, are on the other hand extremely advantageous as the connections 31, 32 can be easily disconnected after the bag has been filled, thus enabling said filled bag to obtain its normal block-shape.

It will be obvious that the disconnectable glue connection 31, 32 between a corner flap part and an opposite wall part of the bag, can also be accomplished advantageously upon the corner flap parts situated at the location of the filling valve, so that a plastic bag of this type can be easier disposed upon a filling mouth of a filling machine.

Referring now to FIG. **5*a* it is clearly illustrated that the back wall parts 33 and 34 keep the layer 22*b* of the non-woven pocket 22 remote from layer 22*a* of said pocket, through the glue connections 31 and 32**.

Should said glue connections 31 and 32 be omitted, air flowing into the bag simultaneously with the powder, would be able to press the corner flap in the direction of the bottom covering foil layer 21, thus pressing the non-woven layers **22*a* and 22*b* upon each other, which would lead to a considerable decrease in the venting capacity of the pocket 22**.

It might even happen that the quantity of air within the bag is excessive to such an extent that the plastic bag explodes. The latter is however, absolutely excluded when using the glue connections 31 and 32.

Figure 7:
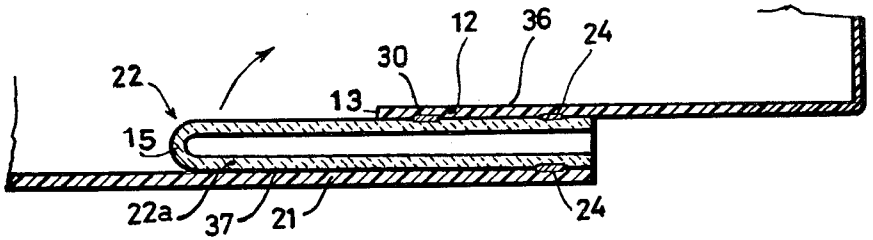
FIG. 7 is a section according to line VII—VII in FIG. 6.

Referring now to FIG. 7 filling nozzles (not shown) blowing the air substantially in the direction of the venting pocket 22 may prevent said air of turning over the portion of pocket 22 extending beyond the end edge 13 of the second corner flap 12, thus causing said portion of pocket 22 to come to lie upon side 36 of the second corner flap. The latter feature would obviously considerably decrese the venting capacity of the bag.

Figure 6:
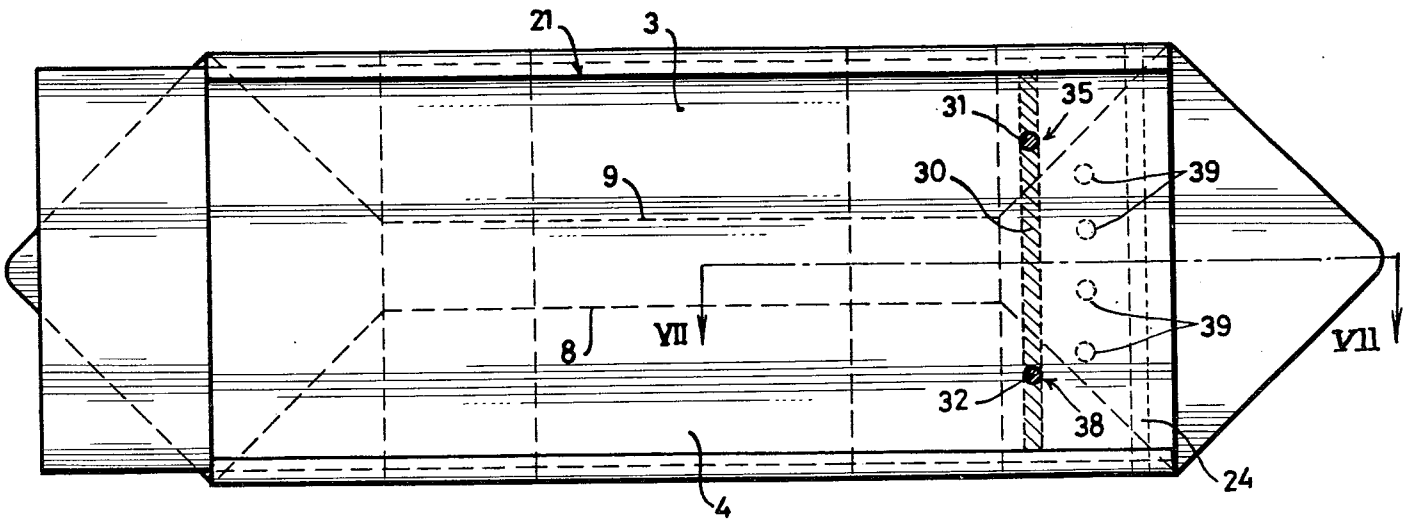
FIG. 6 is a plan view of the bottom of a modified embodiment of a plastic bag according to the invention.

So as to overcome this shortcoming, it is recommended to adhere the filtering layer **22*a* of pocket 22, e.g. by means of a second glue connection 37, to the bottom flaps 3 and 4 or to the bottom covering foil layer 21, which latter solution is the most convenient as then the folded over bottom flaps 3 and 4 will not overlap each other (see FIG. 6**).

In the latter case the pocket 22 is appropriately retained upon the bottom covering foil layer 21, so that blown air is unable to turn over said pocket 22.

Figure 8:
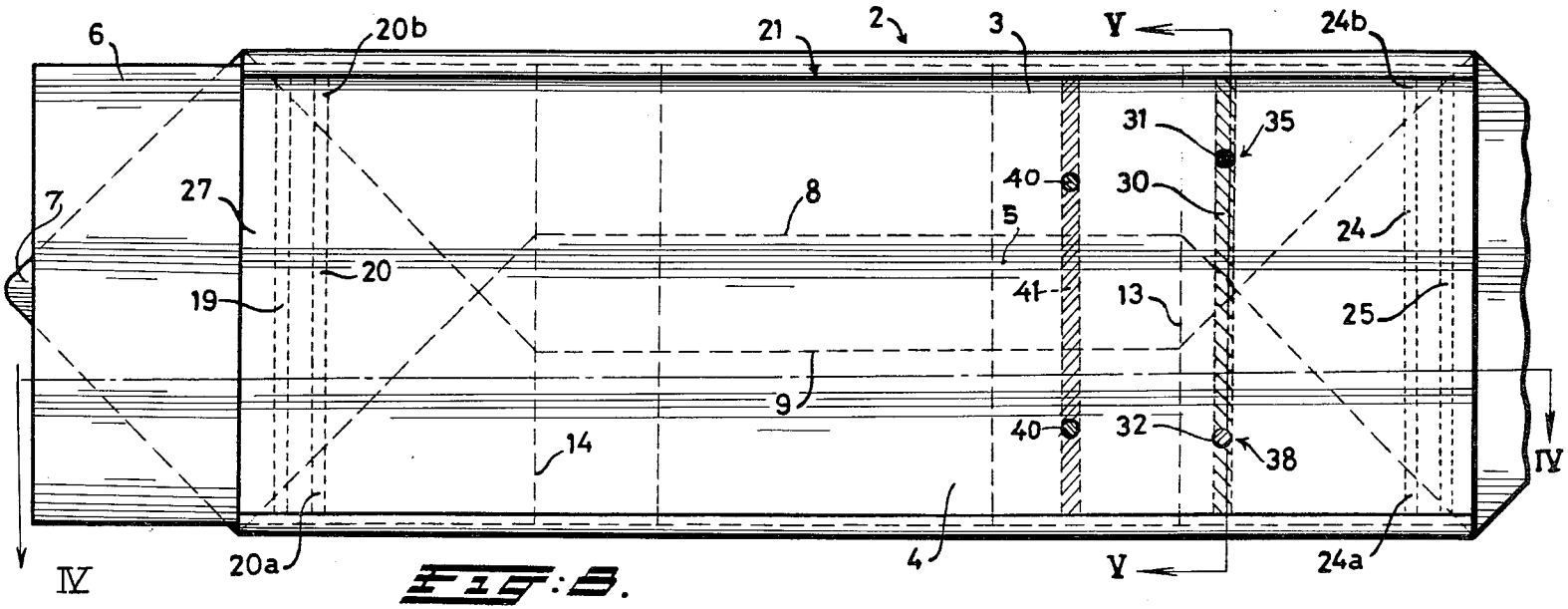
FIG. 8 is a plan view of another embodiment of a plastic bag according to the invention, having a flat bottom.

If the filter layer 22*a* of the pocket 22 is fixed to the bottom flaps 3 and 4, said bottom flaps are provided with bores 40, as shown in FIG. 8. The adhesive of an adhesive connection 41 between the bottom covering layer 21 and the bottom flaps 3 and 4 penetrates through these bores 40 so that an adhesive connection is formed between layer 22*a* of pocket 22 and the bottom flaps 3 and 4.

Sometimes it is recommended to provide bottom covering foil layer 21 with bores 38 thus enabling air to escape from layer 22*a* so that pocket 22 still better retains its venting capacity. The bores 38 extend in that case in between the glue strips or layers 24 and 30.

Although the present invention has been shown and described in connection with preferred embodiments thereof, it will be apparent to those skilled in the art that many variations and modifications may be made without departing from the invention in its broader aspects. It is therefore intended to have the appended claims cover all such variations and modifications as fall within the true spirit and scope of the invention.

What is claimed is:

1. A plastic bag with a filling valve and a gas permeable pocket consisting of dust filtering filtering layers (22*a*, 22*b*) situated at the same bag end as the filling valve (16) and forming a gas permeable connection between the inner side of the bag and the outer side of the bag in order to permit gases to escape from the interior of the bag during and after the filling of the bag with filling material, said filtering pockets being at least partially covered by at least one second corner flap part (12) and a bottom layer of the bag, the bag being provided with means (31, 32) for maintaining the venting capacity of the filtering layer consisting of a disconnectable connection between a corner flap part which partially covers the filtering layer and an opposite portion of the wall of the bag preventing the opposite filtering layers from being pressed upon each other during the filling of the bag.

2. The plastic bag of claim 1, wherein the means for maintaining the venting capacity of the filtering layer consists of a disconnectable connection between a corner flap part which partially covers the filtering layer and an opposite portion of the wall of the bag.

3. The plastic bag of claim 2, wherein the disconnectable connection consists of a plastic glue material.

4. The plastic bag of claim 2, wherein the disconnectable connection consists of a continuous layer of material used for forming a glue connection, said layer continuously extending through at least one opening in the corner flap between the filtering layer and a wall portion of the bag situated opposite the said corner flap.

5. The plastic bag of claim 1, wherein one layer of the pocket (22) is adhered, through a glue connection (37) to the bottom (2) in the region between the end edge (13) of the second corner flap (12) and the edge (15) of the filtering pocket (22).

6. The plastic bag of claim 5, wherein the glue connection (37) is connected with a bottom covering foil layer (21), whilst the bottom flaps do not overlap each other.

7. The plastic bag of claim 6, wherein the bottom (2) of the bag comprises a bottom covering foil layer (21) provided with bores (39) which are a most inwardly situated glue connection (30) and a more outwardly situated glue connection (24).

8. The plastic bag of claim 1, wherein the layer of the pocket is connected to the bottom flaps by means of an adhesive extending through bores.

9. The plastic bag of claim 6, wherein the corner flap (12) is provided with bores (39) which are disposed between a most inwardly situated glue connection (30) and a more outwardly situated glue connection (24).

* * * * *